US012287165B2

(12) United States Patent
Gagne et al.

(10) Patent No.: US 12,287,165 B2
(45) Date of Patent: Apr. 29, 2025

(54) EXTRACTOR FOR AN AUTOLOADING FIREARM

(71) Applicant: Sig Sauer, Inc., Newington, NH (US)

(72) Inventors: Lucas P. Gagne, Dover, NH (US); Aaron C Sakash, Somersworth, NH (US); Bryan C. Dustin, Strafford, NH (US); David L. Steimke, Epping, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 18/353,530

(22) Filed: Jul. 17, 2023

(65) Prior Publication Data

US 2024/0035768 A1 Feb. 1, 2024

Related U.S. Application Data

(60) Provisional application No. 63/369,398, filed on Jul. 26, 2022.

(51) Int. Cl.
*F41A 15/14* (2006.01)

(52) U.S. Cl.
CPC ..... *F41A 15/14* (2013.01)

(58) Field of Classification Search
CPC ..... F41A 15/14
See application file for complete search history.

(56) References Cited

U.S. PATENT DOCUMENTS 2,591,733 A * 4/1952 Simpson ..... F41A 15/14 42/25
2,712,192 A * 7/1955 Dixon ..... F41A 15/14 42/25
6,182,389 B1 * 2/2001 Lewis ..... F41A 3/26 89/185
6,389,725 B1 * 5/2002 Denuit ..... F41A 9/56 42/25
6,484,430 B1 * 11/2002 Robinson ..... F41A 3/26 42/25
6,609,319 B1 * 8/2003 Olson ..... F41A 15/14 89/185
8,745,910 B2 * 6/2014 Zukowski ..... F41A 15/14 42/25

(Continued)

FOREIGN PATENT DOCUMENTS

CA 3222232 A1 2/2023

OTHER PUBLICATIONS

International Search Report and Written Opinion for PCT/US2024/013786. Mailed Jul. 12, 2024.

*Primary Examiner* — Joshua E Freeman
(74) *Attorney, Agent, or Firm* — Finch & Maloney PLLC

(57) ABSTRACT

Disclosed is an extractor for an autoloading firearm, the extractor having an extractor body extending a proximal end portion to a distal end portion. A knuckle is between the proximal end portion and the distal end portion and defines a pin opening extending crosswise through the extractor, where the pin opening has an elongated shape. During rearward movement of the bolt after firing, the elongated opening enables the extractor to shift downward and/or forward so that part of the extractor contacts the bolt, thereby preventing the extractor from pivoting about the extractor pin.

20 Claims, 8 Drawing Sheets

(56) References Cited

U.S. PATENT DOCUMENTS

| | | | | |
|---|---|---|---|---|
| 8,844,424 | B2 * | 9/2014 | Gomez | F41A 15/12 89/137 |
| 8,984,787 | B1 * | 3/2015 | O'Clair | F41A 15/14 42/25 |
| 9,234,713 | B1 * | 1/2016 | Olson | F41A 9/41 |
| 9,435,596 | B2 * | 9/2016 | Daniel | F41A 15/14 |
| 9,448,020 | B1 * | 9/2016 | Olson | F41A 3/66 |
| 9,658,011 | B2 * | 5/2017 | Gomez | F41A 15/14 |
| 10,215,518 | B1 * | 2/2019 | Kramer | F41A 15/14 |
| 11,371,791 | B2 * | 6/2022 | Kling | F41A 3/66 |
| D1,020,964 | S * | 4/2024 | Geissele | D22/108 |
| 2008/0092733 | A1 * | 4/2008 | Leitner-Wise | F41A 15/14 89/138 |
| 2011/0005383 | A1 * | 1/2011 | Kramer | F24B 5/025 42/17 |
| 2012/0167427 | A1 * | 7/2012 | Zukowski | F41A 15/14 42/25 |
| 2014/0076144 | A1 * | 3/2014 | Gomez | F41A 15/12 42/25 |
| 2014/0090283 | A1 * | 4/2014 | Gomez | F41A 3/26 42/25 |
| 2014/0196339 | A1 * | 7/2014 | Zukowski | F41A 3/12 42/25 |
| 2014/0259842 | A1 * | 9/2014 | Feese | F16F 1/36 42/25 |
| 2016/0178302 | A1 * | 6/2016 | Daniel | F41A 3/16 29/434 |
| 2019/0226784 | A1 * | 7/2019 | Davis | F41A 15/12 |
| 2021/0364244 | A1 * | 11/2021 | Kling | F41A 15/14 |

* cited by examiner

EXTRACTOR FOR AN AUTOLOADING FIREARM

RELATED APPLICATIONS

This application claims the benefit under 35 U.S.C. § 119(e) of U.S. Provisional Patent Application No. 63/369,398, titled EXTRACTOR FOR AN AUTOLOADING FIREARM and filed on Jul. 26, 2022, the contents of which are incorporated herein by reference in its entirety.

TECHNICAL FIELD

The present disclosure relates generally to firearms assemblies and components. More specifically, the present disclosure relates to an extractor for an autoloading firearm.

BACKGROUND

Autoloading firearms use an extractor to remove a spent cartridge casing from the chamber prior to stripping a new round from the top of the magazine and moving the bolt into battery for the next shot. In some firearms, such as AR-15-type rifles, the extractor is pivotably attached to the bolt with a pin and has a hook that engages the cartridge casing by snapping over the rim and seating in the adjacent groove when the bolt chambers a round. As the bolt moves rearward after firing, the hook engaging the rim causes the extractor to draw the casing out of the chamber. As the casing is removed, an ejector on the bolt contacts the opposite side of the casing head to eject the spent casing through the ejection port.

SUMMARY

One aspect of the present disclosure is directed to an extractor for an autoloading rifle, where the extractor has an elongated pin opening. After engaging a cartridge, the elongated pin opening enables the extractor to shift downward and/or forward to a position where it is prevented from pivoting about the extractor pin. Accordingly, the likelihood of the extractor disengaging from the cartridge prior to ejection is reduced. Additional aspects of the present disclosure include a parts kit including the extractor, a bolt assembly with the extractor, a rifle subassembly (e.g., a rifle upper receiver assembly) including the extractor, and a rifle including the extractor. Numerous variations and embodiments will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
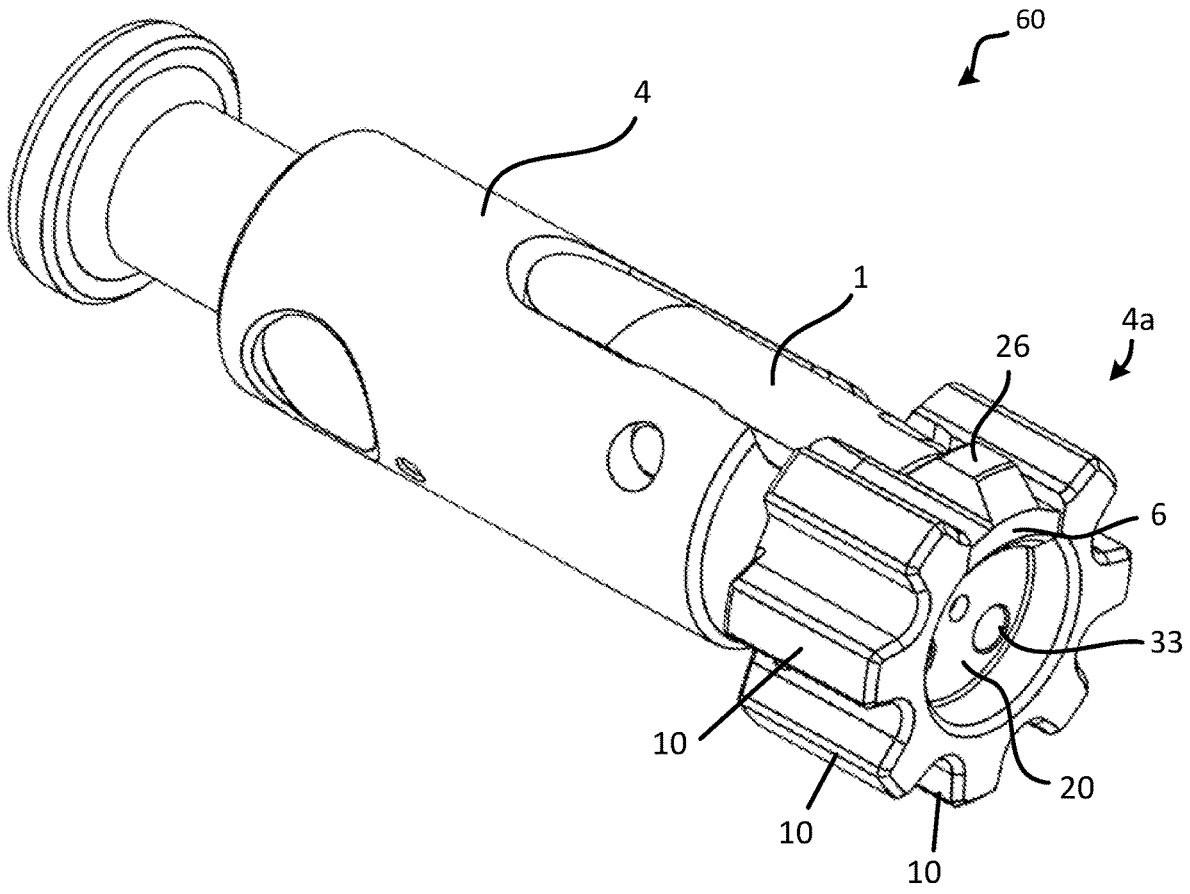
FIG. 1 is a front perspective view of bolt assembly that includes a bolt and an extractor, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is an extractor for an autoloading firearm, such as a semi-automatic or automatic rifle, a machine gun, or a semiautomatic handgun. In one example embodiment, the extractor includes a hook on the distal end and the extractor is configured to be retained with a rifle bolt using a pin extending crosswise through a pin opening. Similar to traditional extractors, the extractor hook can snap over a cartridge rim when the bolt chambers a round. Unlike traditional extractors, however, the pin opening is elongated, such as having a slot or oval shape, rather than a circular shape. As the bolt travels rearward with the extractor hook engaged in the cartridge groove, the elongated pin opening allows the extractor to shift downward and/or forward with respect to the bolt so that part of the extractor contacts the bolt and prevents the extractor from pivoting to disengage from the casing prior to ejecting the casing.

In one such embodiment, the pin opening is elongated along an axis of about 100°-135° with respect to the bore axis, such as from 110°-120°, or about 115°. As the bolt travels rearward with the extractor hook engaged in the cartridge groove, the extractor shifts downward and slightly forward so that the rear end portion of the extractor contacts the bolt and the extractor cannot pivot to disengage from the casing. In another embodiment, the pin opening is elongated along an axis that is generally parallel to the bore axis, where the extractor shifts slightly forward so that laterally extending portions on the extractor's rear end portion engage sloped walls of a transverse slot defined in the bolt. This engagement with the slot's sloped walls prevents the extractor from pivoting. In yet another embodiment, a protrusion on the bottom and forward portion of the extractor engages a protrusion recess to produce a binding engagement that prevents the extractor from pivoting out of engagement with the cartridge casing. Advantageously, the elongated or non-circular pin opening can eliminate or significantly reduce the occurrence of failure-to-extract malfunctions (FTE) by allowing the extractor to shift to a position where it cannot pivot about the extractor pin.

An extractor in accordance with the present disclosure can be a stand-alone part or a component of a parts kit for a rifle or handgun. In other embodiment, an extractor can be part of a bolt assembly or bolt-carrier group. In yet other embodiments, an extractor can be part of a rifle subassembly (e.g., a rifle upper receiver) or a complete rifle.

OVERVIEW

In an autoloading firearm, such as a machine gun or semi-automatic rifle, the process of extracting a spent cartridge and reloading the rifle for the next shot occurs very quickly (e.g., within 10 milliseconds) and includes forceful or violent movements on the moving parts. At battery, for example, the cartridge is in the chamber with the bolt closed and locked against the cartridge head and with the extractor hook received in the casing groove. Upon firing, combustion gases propel the projectile out of the barrel. High-pressure gases in the barrel then cycle the action by passing through a gas tube to the gas key of the bolt carrier (known as direct impingement system), or by actuating a gas piston that in turn moves rearward to drive the bolt carrier rearward (known as a gas piston system). In either type of system, the bolt carrier is driven rearward by high pressure gases. After some initial rearward movement of the carrier, the bolt rotates to the unlocked position and is drawn rearward by the carrier. During this rearward movement, the extractor draws the spent casing out of the chamber due to the extractor hook being hooked over the cartridge rim. As the bolt continues to travel rearward, the spent casing is ejected through the ejection port, followed by the bolt and carrier returning forward by force of the recoil spring. As the bolt returns forward, the bolt strips a cartridge from the top of the magazine and pushes it into the chamber, then rotates to the locked position. During this process, the extractor contacts the casing head, causing the extractor to snap over the cartridge rim.

The process described above can occur many times in rapid succession. During each cycle, forces of 500-700 lbf are applied to the extractor and other components of the action. Despite the extractor hooking over the cartridge rim, the extractor may fail to extract the spent cartridge casing for a variety of reasons. Even when the extractor is made of steel or other durable metals, the forces exerted on the extractor (and/or other components) cause the extractor to flex or bend temporarily. This flexing may be sufficient in itself to disengage the extractor hook from the cartridge rim. Another factor that affects case extraction is the casing geometry and fit within the chamber. For example, a cartridge casing that is slightly tapered from the head to the projectile mouth is typically easier to remove from the chamber. A casing of more true cylindrical geometry can be more difficult to remove from the chamber due to frictional forces. Also, since the extractor engages one side of the cartridge rim, forces are not applied evenly to the casing along the bore axis, but instead the casing is drawn out from one side, which biases the casing against the chamber wall and increases friction. In addition, the chamber wall may have defects or a surface finish (e.g., chrome lining) that increases friction on the casing. Alone or in combination, force involved in firing the rifle and cycling the action can result in a failure to extract the spent casing (a "FTE malfunction").

To clear an FTE malfunction, the operator typically removes the magazine, followed by cycling the action using the charging handle and bolt release so as to reengage the extractor with the casing and eject the spent casing. In some cases, however, this procedure still fails to remove the spent casing and other actions are needed to remove the casing. Although an FTE malfunction is relatively infrequent under ordinary circumstances, the FTE is, at minimum, an inconvenience. In a combat situation, for example, an FTE malfunction can expose the operator to enemy fire while the operator rexolves the malfunction. Thus, a need exists for improvements to an extractor for autoloading firearms.

Although some embodiments of the present disclosure are discussed in the context of an extractor for a rifle based on the AR-15 platform, the concepts of an extractor disclosed herein can be applied to other firearms, including semiautomatic or automatic rifles based on other platforms, machine guns, and semiautomatic handguns.

Further, embodiments of a bolt assembly and extractor are illustrated in the figures with the extractor positioned along the top of the bolt; however, it is appreciated that the extractor may typically occupy other positions (e.g., at about the 10 o'clock position as viewed looking into the barrel) and that the bolt rotates between locked and unlocked positions during the firing cycle. Accordingly, the rotational position of the bolt and extractor is shown in the figures for ease of discussion and is not indicative of any particular required position. Numerous variations and embodiments will be apparent in light of the present disclosure.

EXAMPLE EMBODIMENTS

FIG. 1 is a front perspective view of a bolt assembly 60 that includes a bolt 4 and an extractor 1, in accordance with an embodiment of the present disclosure. The bolt 4 can be configured to be received in a bolt carrier (not shown), as will be appreciated. A distal end portion 4*a* of the bolt 4 includes lugs 10 arranged circumferentially around a recessed breech face 20. The breech face 20 defines one or more ejector openings 33 for an ejector 34 (e.g., a pin, not shown). The ejector opening(s) 33 are positioned 180° from the extractor 1 in some embodiments. In this example, the extractor 1 is shown in a resting state and substantially follows the surrounding geometry of the bolt 4, including the outer diameter of the bolt body, the curvature of the extractor hook 6 along the breech face 20, and a lug 26 on the extractor 1.

Figure 2A:
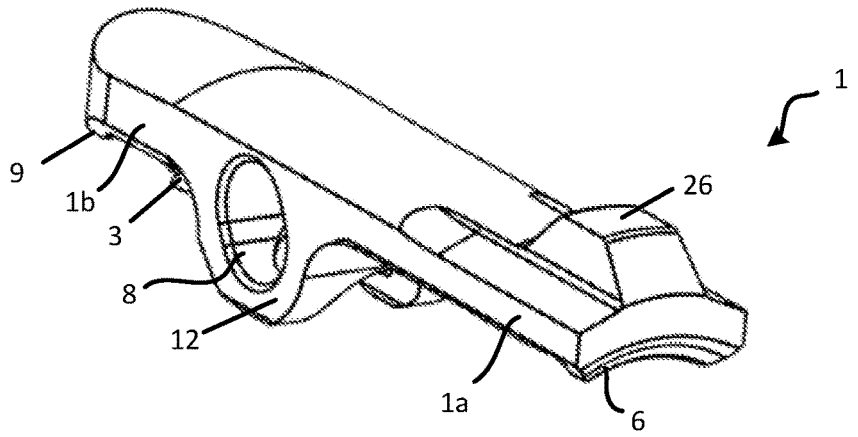
FIG. 2A is a front perspective view of an extractor having an elongated pin opening, in accordance with an embodiment of the present disclosure.
Figure 2B:
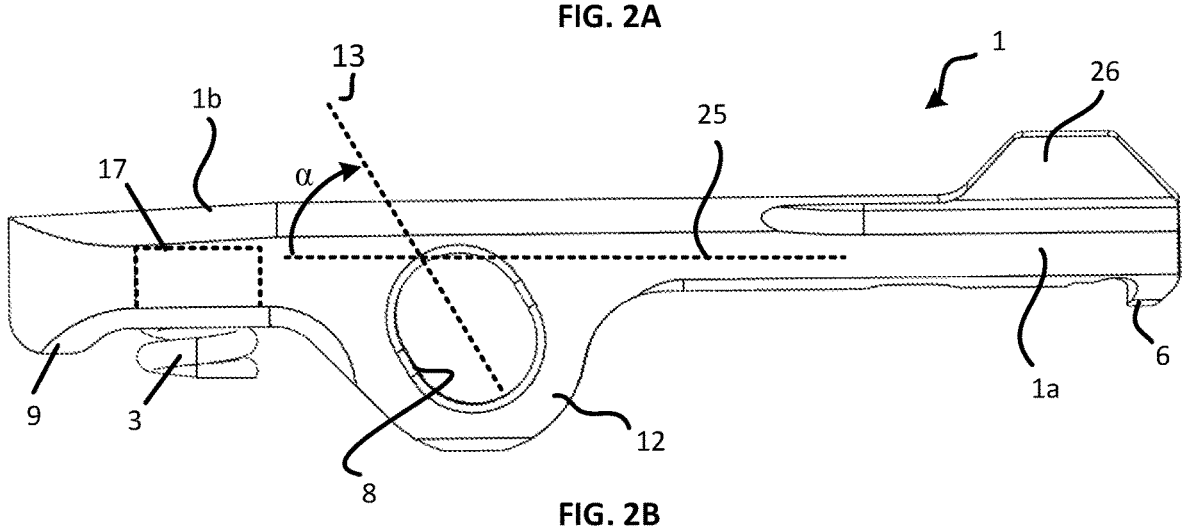
FIG. 2B is a side view of the extractor of FIG. 2A.
Figure 2C:
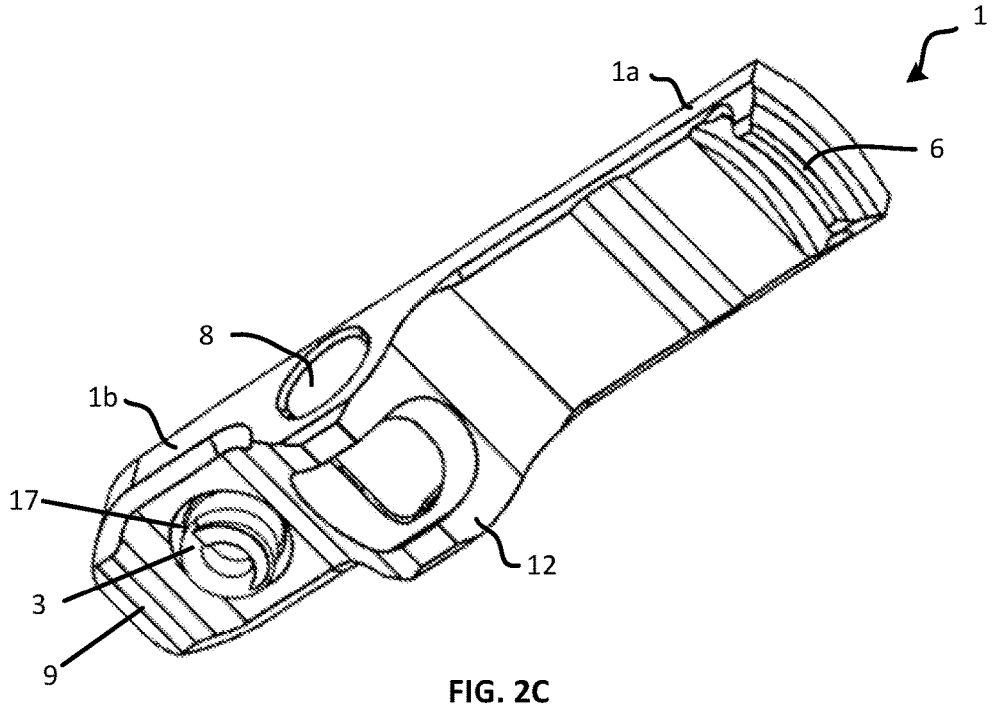
FIG. 2C is a bottom perspective view of the extractor of FIG. 2A.

FIGS. 2A, 2B, and 2C illustrate a front perspective view, a side view, and a bottom perspective view, respectively, of an extractor 1, in accordance with an embodiment of the present disclosure. The extractor 1 extends along a central axis 25 from a proximal end portion 1*b* to a distal end portion 1*a*. The proximal end portion 1*b* defines a stop surface 9 and a spring pocket 17 to receive the extractor spring 3. The distal end portion 1*a* includes a lug 26 on its radially outer side (e.g., top) and defines an extractor hook 6 on the radially inner side (e.g., bottom). An elongated pin opening 8 is between the proximal end portion 1*b* and the distal end portion 1*a*, extending crosswise through a knuckle 12 or similar protrusion on the radially inner side (e.g., bottom) of the extractor 1. In use, the extractor 1 can pivot about the pin opening 8 to enable the extractor hook 6 to snap over and engage a cartridge rim.

Figure 3:
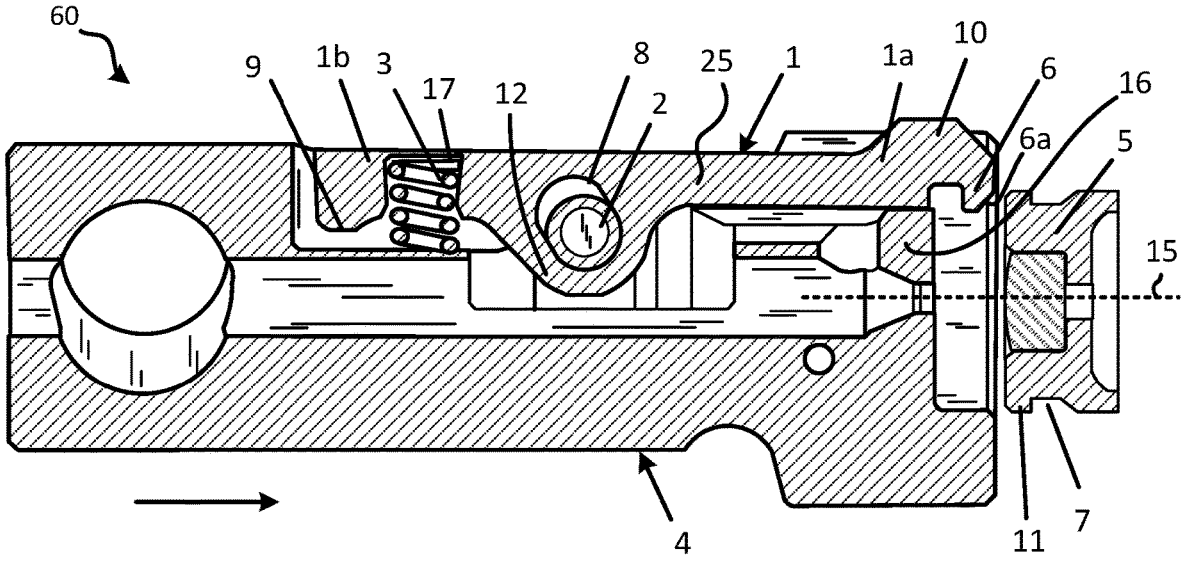
FIG. 3 is a side view showing a longitudinal section of a bolt assembly that includes an extractor with an elongated pin opening, where the extractor is in a resting position, in accordance with an embodiment of the present disclosure.

In some embodiments, the pin opening 8 has an elongated shape that is oriented along an opening axis 13 defining an angle α from 30° to 85° with respect to the central axis 25 (and which is substantially parallel to the bore axis 15 when the extractor 1 is in the resting position as shown, e.g., in FIG. 3). For example, the pin opening 8 has a shape of a slot, an oval, a curve, or other non-circular shape. In some embodiments, the angle α is from 45° to 80°, from 50° to 75°, from 60° to 70°, or about 65°. The angle α can be selected to provide the desired performance. In some embodiments, an angle α of about 45° or less allows for more axial movement of the extractor 1, which may be undesirable in some circumstances. In some embodiments, an angle α closer to 80° or 90° may result in the extractor being prone to disengaging from the cartridge due to a dynamic response to extraction loads, for example.

The pin opening 8 is sized so that the extractor 1 can move with respect to the pin 2 (shown in FIGS. 3-4), such as a sliding movement along the opening axis 13. The pin opening 8 has a length along the opening axis 13 that is greater than the diameter of the pin 2, such as at least 110%, at least 120%, at least 130%, at least 140%, at least 150%, or some other amount greater than the diameter of the pin 2. In one embodiment, the length is about 120%-130% of the pin diameter. The length along the opening axis 13 can be selected based on one or more factors that include the position of the knuckle 12, the distance between the stop surface 9 and the bolt 4, the angle α, and the depth of the extractor hook 6. In some embodiments, the pin opening 8 has a length that permits the stop surface 9 to contact the bolt 4 with room to spare between the pin 2 and the upper end of the pin opening 8.

An extractor spring 3 is positioned between the proximal end portion 1*b* of the extractor 1 and the bolt 4 (shown in FIGS. 3-4) and applies a biasing force to the proximal end portion 1*b*. The extractor spring 3 can be oriented generally perpendicular to the bore axis 15 to bias the distal end portion 1*a* of the extractor 1 downward (e.g., towards the bolt 4 or towards an engaged position). In this example, the extractor spring 3 is received in a spring pocket 17 defined in the extractor 1. In contrast to prior art extractors where the extractor spring is at or very close to the proximal end of the extractor, the extractor spring 3 and spring pocket 17 in this example are spaced from the proximal end to allow the stop surface 9 to contact the bolt 4 during extraction. In one embodiment, the extractor spring 3 is about midway between the stop surface 9 and the knuckle 12.

Figure 4:
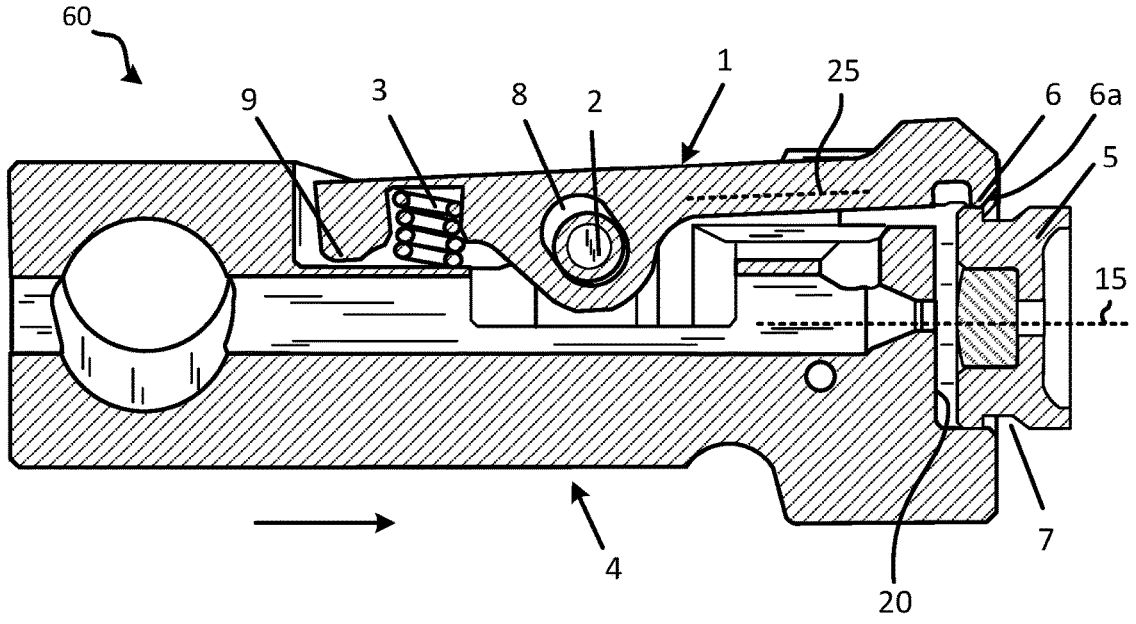
FIG. 4 is a side view showing a longitudinal section of the bolt assembly of FIG. 3, where the distal end portion of the extractor is pivoted upward to a raised position for snapping over a rim of a cartridge, in accordance with an embodiment of the present disclosure.
Figure 5:
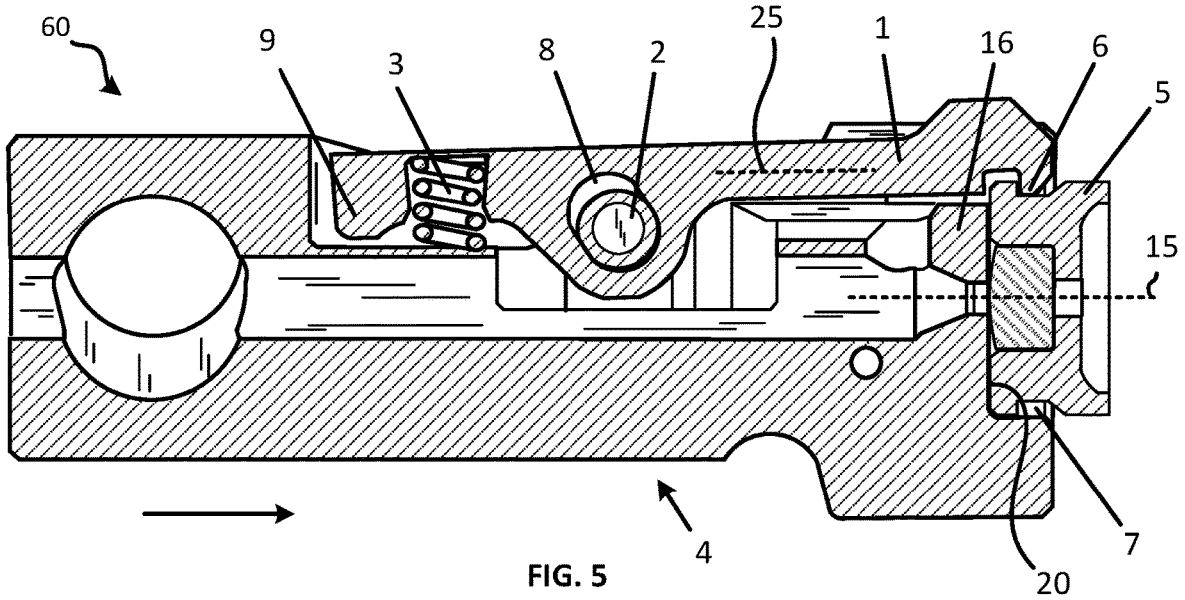
FIG. 5 is a side view showing a longitudinal section of the bolt assembly of FIG. 3, where the extractor has snapped over the cartridge rim, in accordance with an embodiment of the present disclosure.
Figure 6:
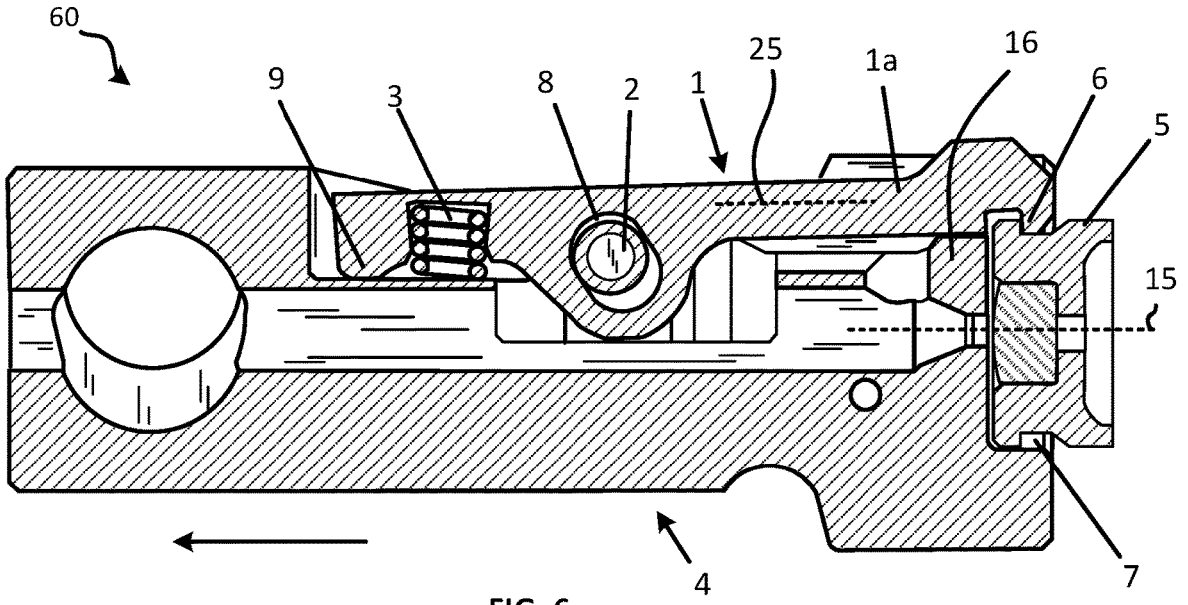
FIG. 6 is a side view showing a longitudinal section of the bolt assembly of FIG. 5 with the extractor in a locked position, where the bolt has started moving rearward and has caused the extractor to shift down and slightly forward so that the stop surface at the rear end of the extractor contacts the bolt, in accordance with an embodiment of the present disclosure.

FIGS. 3-6 illustrate side views showing longitudinal sections of a bolt assembly 60 of an autoloading rifle, where the bolt 4 has an extractor 1 movable between various positions, in accordance with an embodiment of the present disclosure. For example, the extractor 1 can pivot from a resting position (shown in FIG. 3) in which the pin 2 occupies a lower portion of the pin opening 8 and the distal end portion 1*a* contacts a forward shelf 16 of the bolt 4. Another position, shown for example in FIG. 4, is where the distal end portion 1*a* is raised (or deflected radially outward) for snapping over a cartridge rim. Another position, shown for example in FIG. 6, is a locked position where the stop surface 9 contacts the bolt 4 and the distal end portion 1*a* has substantially returned to the resting position.

In FIG. 3, the bolt assembly 60 is moving forward towards battery and is positioned for the extractor 1 to make contact with a cartridge 5, in accordance with an embodiment of the present disclosure. In this example, the extractor 1 remains in the resting or default position with the pin 2 in the downward and forward or lower portion of the pin opening 8 (as illustrated). In this position the stop surface 9 is spaced from the bolt 4 with the extractor spring 3 biasing the distal end portion 1*a* into contact with a forward shelf 16 of the bolt 4. The extractor 1 is substantially oriented along the bore axis 15 and the sloped distal face 6*a* of the extractor hook 6 is about to contact the cartridge 5. The extractor hook 6 has a sloped distal face 6*a* that cams the extractor 1 upward when the extractor 1 contacts the cartridge 5. This upward movement of the extractor hook 6 enables the extractor hook 6 to snap over the cartridge rim and settle into the cartridge groove 7. The top of the distal end portion 1*a* includes a lug 10.

In FIG. 4, the distal end portion 1*a* of the extractor 1 is pivoted upward (e.g., radially outward from the bolt 4) after the sloped distal face 6*a* of the extractor hook 6 has made contact with the cartridge 5. Here, the cartridge 5 is entering the recess of the breech face 20 of the bolt 4. Note that the stop surface 9 is nearly pivoted into contact with the bolt 4. The pin 2 remains in the lower portion of the pin opening 8 (e.g., closer to the bore axis 15).

In FIG. 5, the head of the cartridge 5 is seated against the breech face 20 and the extractor hook 6 has snapped over the cartridge rim and is seated in the cartridge groove 7. Note that the extractor 1 has substantially resumed the resting position shown in FIG. 3, except that in this example the extractor hook 6 being seated in the cartridge groove 7 prevents the distal end portion 1*a* from making contact with the forward shelf 16. Accordingly, the extractor 1 has not fully resumed the resting position. Accordingly, the extractor hook 6 can move further into the cartridge groove 7 if the cartridge 5 shifts or has a deeper groove 7. Note also that the stop surface 9 is spaced from the bolt 4.

In FIG. 6, the bolt assembly 60 has started moving rearward with the extractor hook 6 seated in the cartridge groove 7. As a result of rearward movement of the bolt 4, the extractor 1 has shifted down (e.g., radially inward) and slightly forward along the elongated pin opening 8 so that the stop surface 9 at the proximal end of the extractor 1 contacts the bolt 4. In this position, the pin 2 occupies the middle or radially outer portion of the pin opening 8 (e.g., further away from the bore axis 15). Note that a slight gap exists between the pin 2 and the outermost part of the pin opening 8, providing additional freedom of movement so that the stop surface 9 can make contact with the bolt 4. Note also that the cartridge 5 has shifted slightly forward from the breech face 20 due to the forward movement of the extractor 1 along the bore axis 15 relative to the bolt 4 and/or rearward movement of the bolt assembly 60. In this position, the stop surface 9 contacts the bolt 4 and the extractor 1 is prevented from pivoting out of the cartridge groove 7. Accordingly, the likelihood that the extractor 1 disengages from the cartridge 5 is reduced or eliminated. After ejecting the spent cartridge 5 case, the extractor will resume the resting position, such as shown in FIG. 3.

Figure 7:
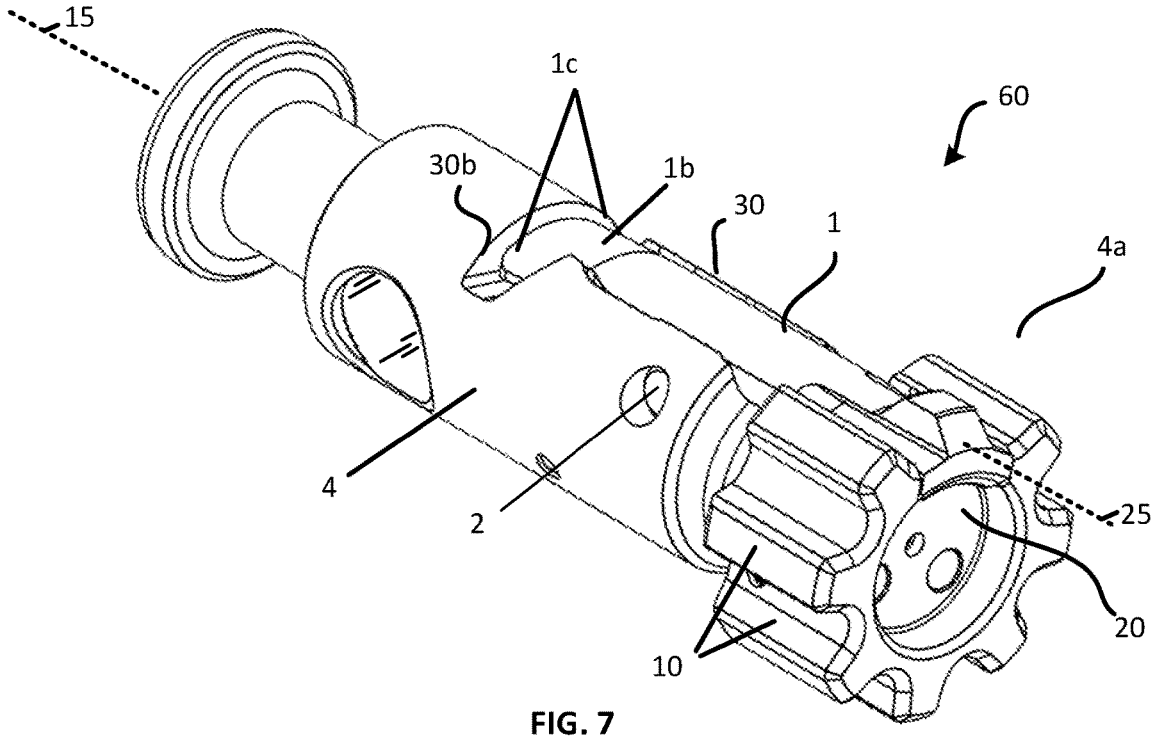
FIG. 7 is a front perspective view of a bolt assembly that includes a bolt and extractor, in accordance with an embodiment of the present disclosure.
Figure 8:
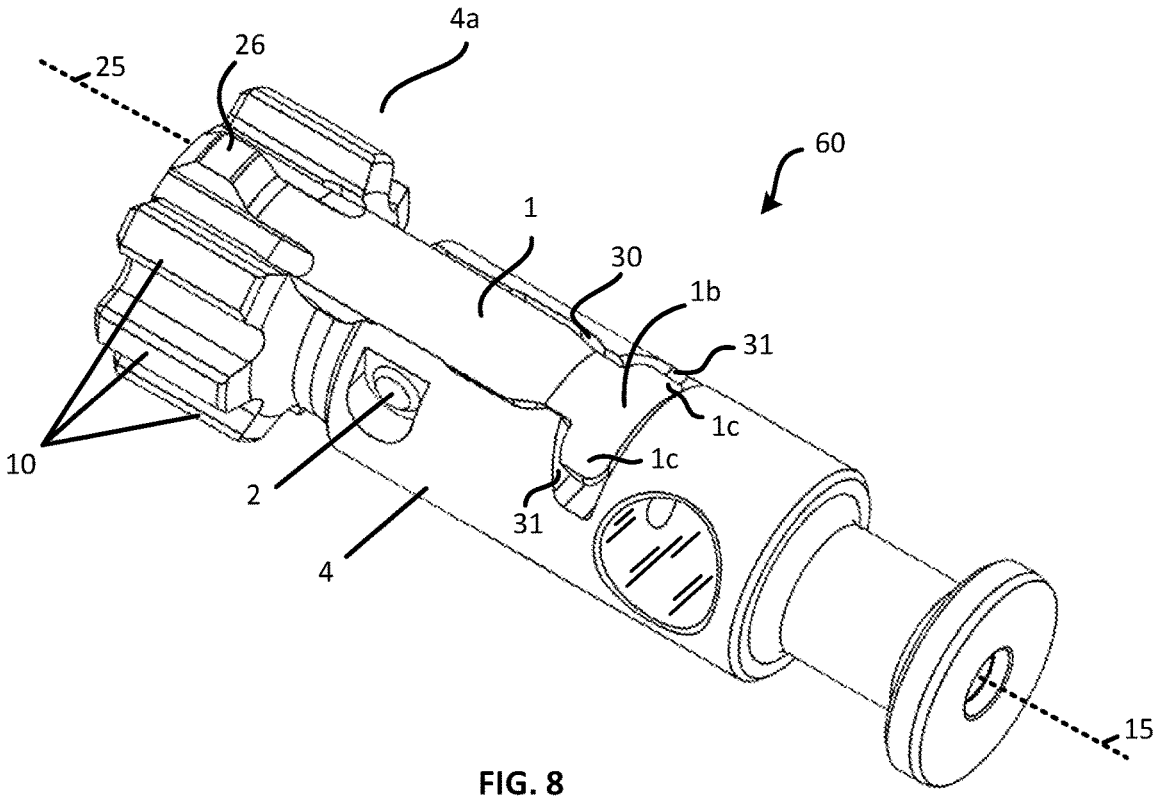
FIG. 8 is a rear perspective view of the bolt assembly of FIG. 7.
Figure 9:
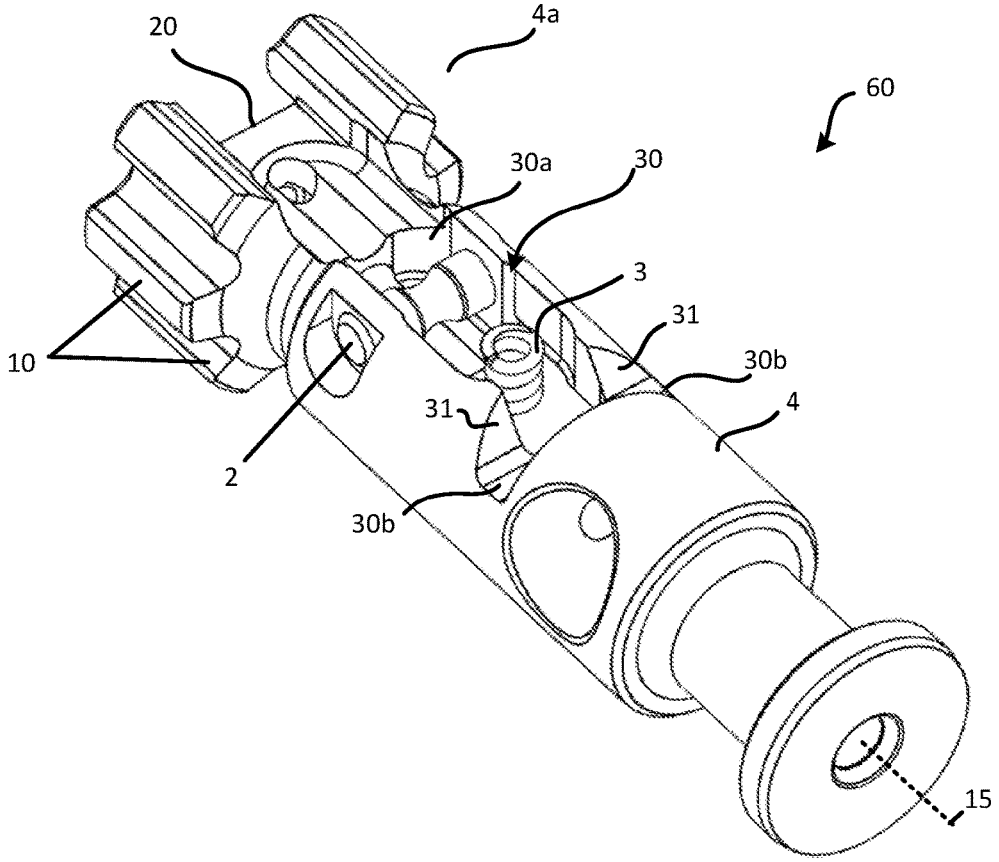
FIG. 9 is a rear perspective view showing a bolt without extractor, in accordance with an embodiment of the present disclosure.
Figure 10:
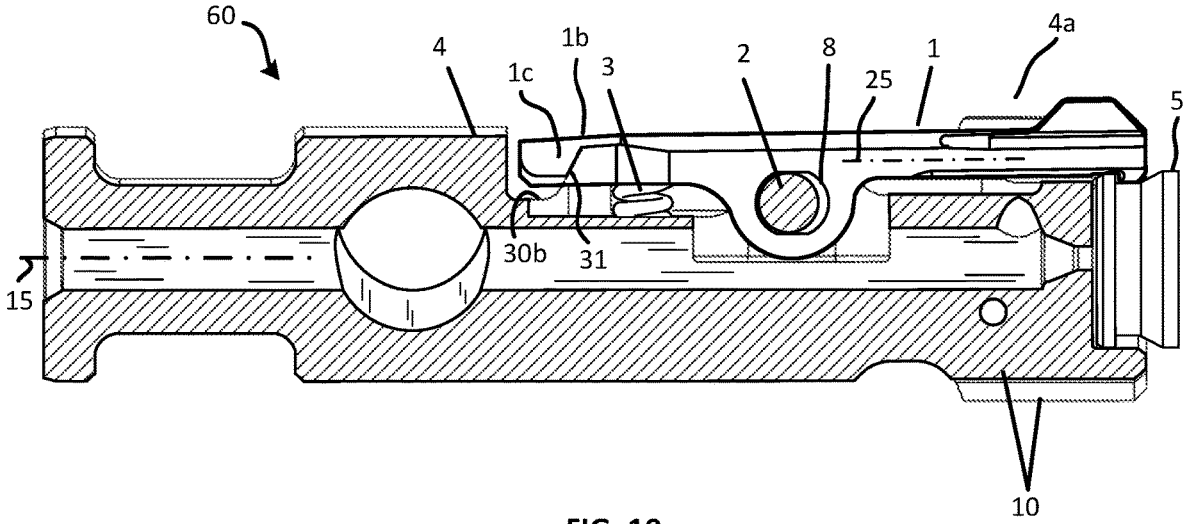
FIG. 10 is a side view of a bolt assembly with the bolt shown in cross section and where the extractor is shown engaging a cartridge, in accordance with an embodiment of the present disclosure.

FIGS. 7-10 illustrate views of bolt assembly 60 in accordance with another embodiment. FIG. 7 is a front perspective view of the bolt assembly 60, FIG. 8 is a rear perspective view of the bolt assembly 60, FIG. 9 is a rear perspective view showing a bolt 4 without the extractor 1, and FIG. 10 is a side view of the bolt assembly 60 with the bolt 4 shown in cross-section to better show the extractor 1.

The bolt assembly 60 includes a bolt 4, extractor 1, extractor pin 2, and extractor spring 3. The distal end portion 4*a* of the bolt 4 includes lugs 10 arranged around a recessed breech face 20. The extractor pin 2 extends crosswise through the bolt and retains the extractor 1 in a recess 30 defined in the bolt 4. The recess 30 includes a longitudinal portion 30*a* that is sized and configured to house the extractor 1 in addition to a transverse portion 30*b* positioned to receive lateral extensions 1*c* on the proximal end portion 1*b* of the extractor 1. For example, each lateral extension 1*c* protrudes laterally away from the proximal end portion 1*b* to define a T shape.

As can be seen in FIG. 9, for example, the transverse portion 30*b* of the recess 30 includes sloping distal faces 31 that extend distally and away from the bore axis 15 (e.g., upward and forward as oriented in FIG. 9). During the extraction process, the extractor 1 is engaged with the cartridge 5 as the bolt 4 moves rearward, such as shown in FIG. 10. As a result of the elongated pin opening 8, the extractor 1 can shift slightly forward with respect to the bolt 4. In turn, lateral extensions 1*c* on the proximal end portion 1*b* of the extractor 1 contact the sloping distal faces 31 (shown in FIG. 9) and prevent the extractor 1 from pivoting about the extractor pin 2 to a release position with respect to the cartridge 5. Due to the contact between the lateral extensions 1*c* and the sloping distal faces 31 of the bolt 4, the extractor 1 is prevented from disengaging from the cartridge 5 prior to ejection as the bolt 4 moves rearward.

In this embodiment, the pin opening 8 is elongated along a central axis 25 of the extractor 1, which is parallel to or substantially parallel to the bore axis 15 when the extractor 1 is in the resting position, such as shown in FIGS. 7-8. In other embodiments, the pin opening 8 can be elongated along an axis that defines an angle $\alpha$ from 0° to 30° with respect to the central axis 25 so as to bias the proximal end portion 1*b* of the extractor into engagement with the sloping distal faces of the recess 30 during extraction. An angle $\alpha$ of 0-20°, 0-10°, or 10-20° can be used, for example. In this example, the longitudinal dimension of the pin opening 8 is about 115% of the pin diameter.

Figure 11:
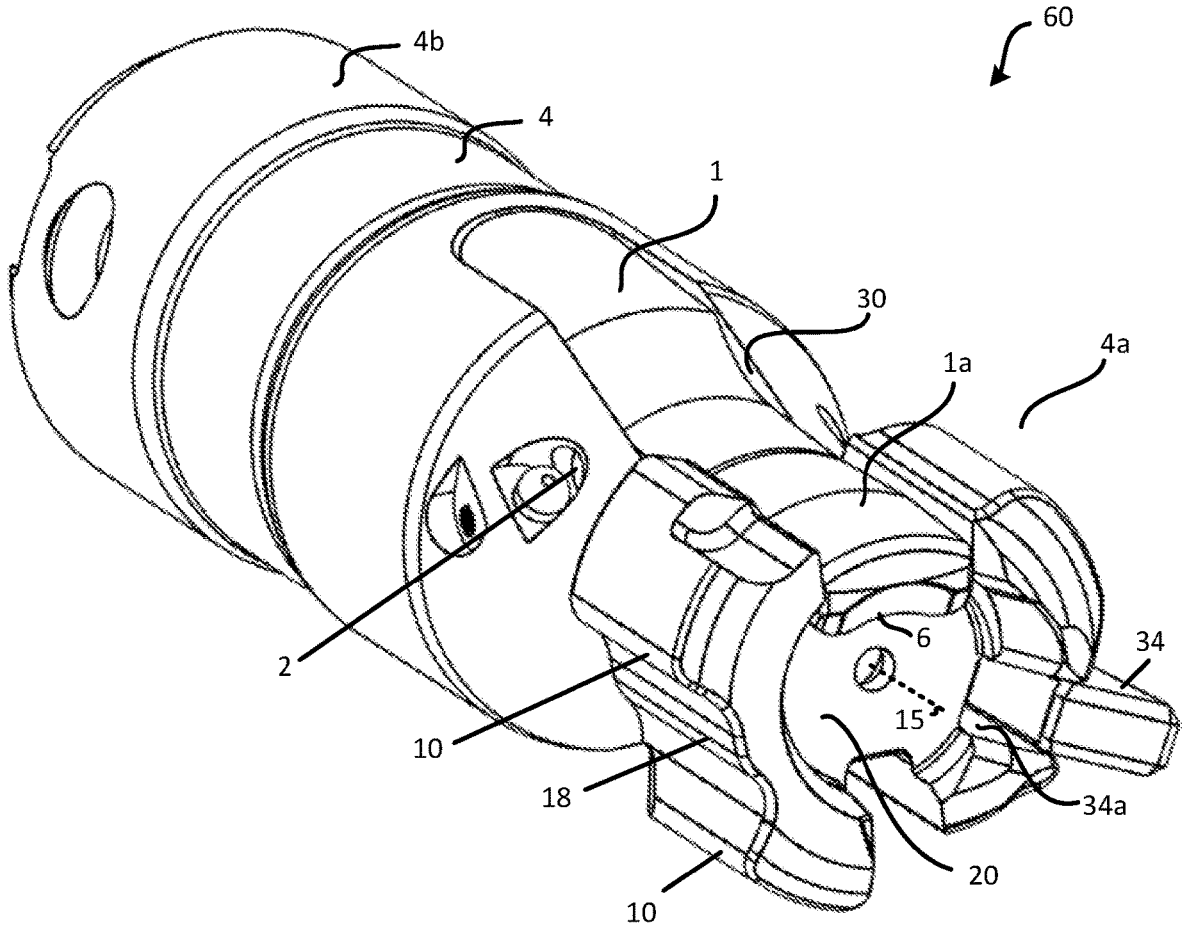
FIG. 11 illustrates a front perspective view of a bolt assembly that includes a bolt and extractor, in accordance with another embodiment of the present disclosure.

FIG. 11 illustrates a front perspective view of a bolt assembly 60 in accordance with another embodiment of the present disclosure. In this example, the bolt 4 is configured for use with a machine gun and has an enlarged proximal end portion 4*b*. The extractor 1 is retained in a recess 30 using an extractor pin 2 extending crosswise to the bore axis 15. The extractor 1 generally follows the contour of the bolt 4, including following an increase in diameter from the distal end portion 4*a* toward the proximal end portion 4*b* of the bolt 4. Lugs 10 on the distal end portion 4*a* are arranged around a recessed breech face 20 with lands 18 arranged circumferentially between lugs 10. An ejector 34 is retained in an ejector slot 34*a* along the side of the bolt 4. The distal end portion 1*a* of the extractor 1 simulates a land 18 between lugs 10 and includes an extractor hook 6 similar to as discussed above.

Figure 12:
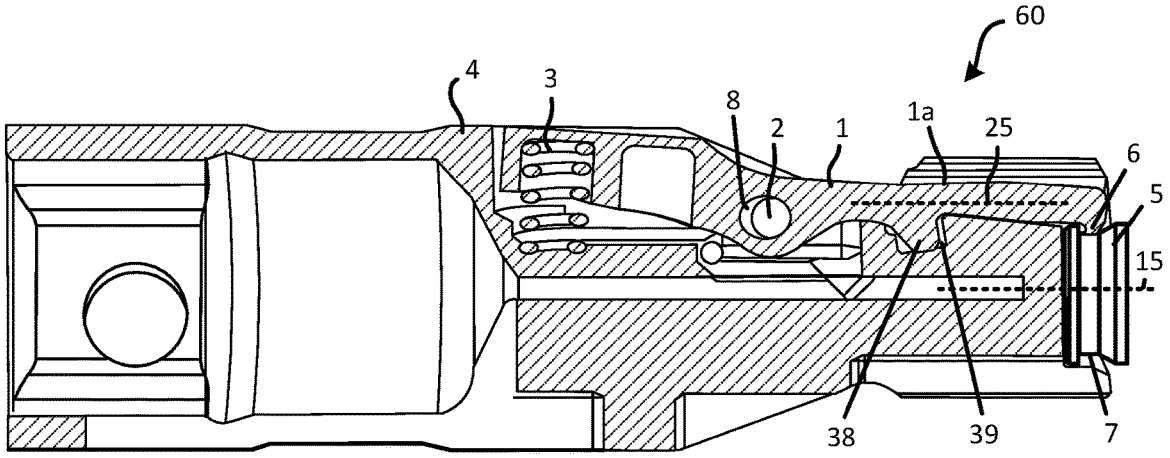
FIGS. 12 and 13 illustrates side views of the bolt assembly of FIG. 11 with the extractor engaging a cartridge and the bolt at various stages of action, in accordance with some embodiments.
Figure 13:
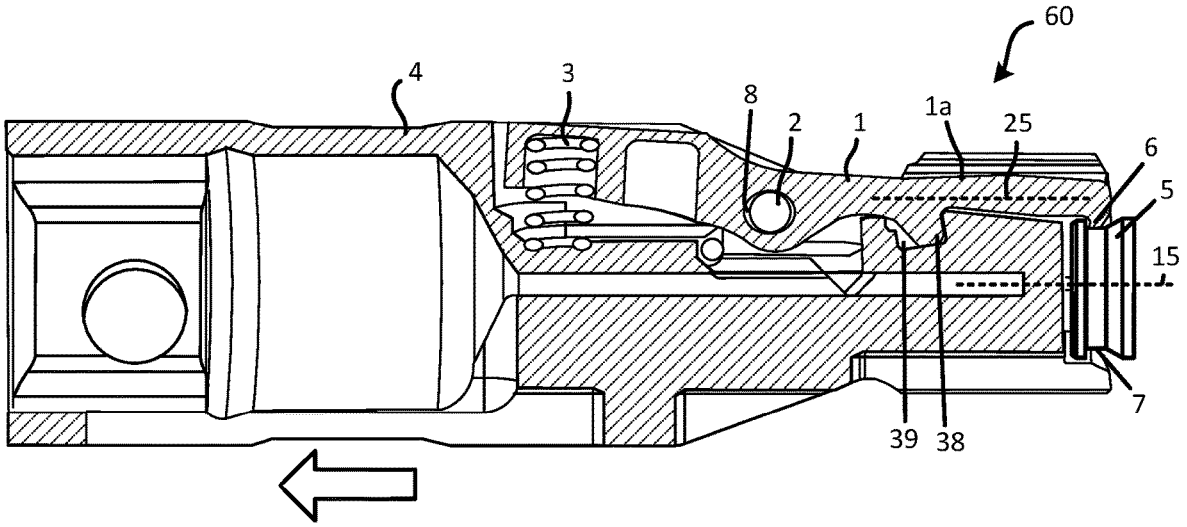

FIGS. 12 and 13 illustrate side views of the bolt assembly 60 of FIG. 11 showing a longitudinal section through the extractor 1 and bolt 4, where the extractor 1 engages a cartridge 5. Note that the pin opening 8 is elongated along a central axis 25 that is substantially parallel to the bore axis 15. The distal end portion 1*a* of the extractor 1 includes a protrusion 38 that is received in a corresponding protrusion recess 39 in the bolt 4. The distal surface of the protrusion 38 slopes forward and the distal surface of the protrusion recess 39 slopes rearward, in some embodiments. Accordingly, the protrusion 38 is configured to engage the protrusion recess 39. When the distal surface of the protrusion 38 engages the distal surface of the protrusion recess 39, the sloping surfaces prevent the extractor from pivoting about the extractor pin 2 due to interference between these sloping surfaces.

In FIG. 12, the extractor hook 6 has snapped over the cartridge rim and occupies the cartridge groove 7. The extractor pin 2 is positioned in the distal portion of the pin opening 8, enabling the extractor 1 to pivot about the extractor pin 2. The cartridge 5 remains seated against the breech face 20 of the bolt 4.

In FIG. 13, the bolt 4 is moving rearward after having engaged the cartridge 5. Here, the cartridge 5 and extractor 1 have shifted forward with respect to the bolt 4, owing to the increased dimension of the elongated pin opening 8. In this position the extractor pin 2 is roughly centered in the elongated pin opening 8. Note that the distal surface of the protrusion 38 engages the distal surface of the protrusion recess 39, resulting in a binding condition that prevents the extractor 1 from pivoting out of engagement with the cartridge 5. Accordingly, the likelihood that the extractor 1 disengages from the cartridge 5 prior to ejection is reduced or eliminated.

FURTHER EXAMPLE EMBODIMENTS

The following examples pertain to further embodiments, from which numerous permutations and configurations will be apparent.

Example 1 is an extractor for an autoloading firearm, the extractor comprising an extractor body extending longitudinally along a central axis from a proximal end portion to a distal end portion; a stop surface on the proximal end portion; an extractor hook on the distal end portion; and a knuckle between the proximal end portion and the distal end portion, the knuckle defining a pin opening extending crosswise through the extractor, wherein the pin opening has an elongated shape.

Example 2 includes the subject matter of Example 1, wherein the pin opening is elongated along an opening axis that defines an angle with the central axis, the angle from 30° to 85°.

Example 3 includes the subject matter of Example 2, wherein the angle is from 45° to 75°.

Example 4 includes the subject matter of Example 2, wherein the angle is from 60° to 70°.

Example 5 includes the subject matter of Example 2, wherein the angle is about 65°.

Example 6 includes the subject matter of Example 1, wherein the pin opening is elongated along an opening axis that defines an angle with the central axis, the angle from 0° to 30°.

Example 7 includes the subject matter of Example 6, wherein the proximal end portion includes one or more laterally extending protrusions.

Example 8 includes the subject matter of any one of Examples 1-7, wherein the pin opening has a length along the opening axis that is from 110% to 120% of a width perpendicular to the opening axis.

Example 9 includes the subject matter of any one of Examples 1-7, wherein the pin opening has a length along the opening axis that is at least 120% of a width perpendicular to the opening axis.

Example 10 includes the subject matter of Example 9, wherein the length is at least 130% of the width.

Example 11 includes the subject matter of any one of Examples 1-10, wherein the pin opening has a slot shape.

Example 12 includes the subject matter of any one of Examples 1-10, wherein the pin opening has an oval shape.

Example 13 includes the subject matter of any one of Examples 1-10, wherein the pin opening has an arcuate shape.

Example 14 includes the subject matter of any one of Examples 1-13, wherein the extractor body defines a spring pocket between the stop surface and the knuckle.

Example 15 includes the subject matter of any one of Examples 1-14, further comprising a lug on the distal end portion.

Example 16 includes the subject matter of any one of Examples 1-15, wherein the extractor is configured for use with an autoloading rifle.

Example 17 includes the subject matter of any one of Examples 1-15, wherein the extractor is configured for use with a semiautomatic handgun.

Example 18 is a bolt assembly comprising the extractor of any one of Examples 1-15.

Example 19 is an autoloading rifle comprising the bolt assembly of Example 18.

Example 20 includes the subject matter of Example 19, the rifle configured for semiautomatic fire and/or automatic fire.

Example 21 includes the subject matter of Example 19, wherein the rifle is an AR-15-type or M16-type rifle.

Example 22 is a parts kit comprising the extractor of any one of Examples 1-17.

Example 23 includes the subject matter of Example 22, and further comprises an extractor spring and a pin.

Example 24 includes the subject matter of Example 23, wherein the parts kit is configured for use with an AR-15-type or M16-type rifle.

Example 25 is an extractor for an autoloading firearm, the extractor comprising an extractor body extending from a proximal end portion to a distal end portion, the distal end portion having an extractor hook configured to engage a firearm cartridge; a knuckle between the proximal end portion and the distal end portion, the knuckle defining a pin opening extending crosswise through the extractor, wherein the pin opening has an elongated shape; and a protrusion on the extractor body between the knuckle and the extractor hook.

Example 26 includes the subject matter of Example 25, wherein a distal surface of the protrusion has a forward slope.

Example 27 includes the subject matter of Example 25 or 26, wherein the distal end portion of the extractor body extends along a central axis and wherein the pin opening is elongated along an opening axis that defines an angle with the central axis, the angle from 0° to 20°.

Example 28 includes the subject matter of any one of Examples 25-27, wherein the pin opening has a length along the opening axis that is from 110% to 130% of a width perpendicular to the opening axis.

Example 29 includes the subject matter of any one of Examples 25-27, wherein the pin opening has a length along the opening axis that is at least 120% of a width perpendicular to the opening axis.

Example 30 includes the subject matter of Example 29, wherein the length is at least 130% of the width.

Example 31 includes the subject matter of any one of Examples 25-30, wherein the pin opening has a slot shape.

Example 32 includes the subject matter of any one of Examples 25-30, wherein the pin opening has an oval shape.

Example 33 includes the subject matter of any one of Examples 25-30, wherein the pin opening has an arcuate shape.

Example 34 includes the subject matter of any one of Examples 25-33, wherein the extractor body defines a spring pocket between the proximal end portion and the knuckle.

Example 35 includes the subject matter of any one of Examples 25-34, further comprising a lug on the distal end portion.

Example 36 includes the subject matter of any one of Examples 25-35, wherein the extractor is configured for use with a machine gun.

Example 37 is a bolt assembly comprising the extractor of any one of Examples 25-36.

Example 28 is a machine gun comprising the bolt assembly of Example 37.

Example 39 is a parts kit comprising the extractor of any one of Examples 25-36.

Example 40 includes the subject matter of Example 39 and further comprises an extractor spring and a pin.

Example 41 includes the subject matter of Example 40 and further comprises a bolt for a machine gun.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An extractor for an autoloading firearm, the extractor comprising:

an extractor body extending longitudinally along a central axis from a proximal end portion to a distal end portion, the proximal end portion defining a stop surface and the distal end portion defining an extractor hook; and a knuckle on the extractor body between the proximal end portion and the distal end portion, the knuckle defining a pin opening extending crosswise through the knuckle, wherein the pin opening is elongated along an opening axis that extends forward and away from the central axis at an angle from 45° to 80°.

2. The extractor of claim 1, wherein the pin opening has a length along the opening axis that is from 110% to 120% of a width perpendicular to the opening axis.

3. The extractor of claim 1, wherein the angle is from 60° to 70°.

4. The extractor of claim 3, wherein the angle is about 65°.

5. The extractor of claim 1, wherein the pin opening has a slot shape.

6. The extractor of claim 1, wherein the proximal end portion has lateral extensions that define a T-shape with the extractor body.

7. The extractor of claim 1, wherein the extractor is configured for use with an autoloading rifle.

8. The extractor of claim 1, wherein the extractor is configured for use with a semiautomatic handgun.

9. A bolt assembly comprising:

a bolt configured for an autoloading rifle and defining a firing pin opening along a central bolt axis;

the extractor of claim 1, wherein the extractor is configured to be assembled with the bolt; and a firing pin configured to be movably received in the firing pin opening.

10. The bolt assembly of claim 9, wherein the autoloading rifle is an AR-15-type rifle.

11. An extractor for an autoloading firearm, the extractor comprising:

an extractor body extending from a proximal end portion to a distal end portion, the distal end portion extending along an extractor central axis and defining an extractor hook configured to engage a firearm cartridge, wherein the extractor body defines a pin opening extending crosswise through the extractor body and having an elongated shape as viewed in cross section; and a protrusion between the pin opening and the extractor hook, the protrusion extending forward and away from the extractor body, wherein a front surface of the protrusion defines an angle of less than 90° with the extractor central axis.

12. The extractor of claim 11, wherein the pin opening is elongated along an opening axis that defines an angle with the central axis, the angle from 0° to 20°.

13. The extractor of claim 12, wherein the pin opening has a length along the opening axis that is at least 110% of a width perpendicular to the opening axis.

14. The extractor of claim 11, wherein the length of the pin opening is at least 120% of the width perpendicular to the opening axis.

15. The extractor of claim 14, wherein the pin opening has a slot shape.

16. The extractor of claim 11, wherein the extractor body defines a spring pocket between the proximal end portion and the knuckle.

17. The extractor of claim 11, further comprising a lug on the distal end portion.

18. A bolt assembly comprising the extractor of claim 11, a bolt, and a pin, wherein:

the extractor is pivotably coupled to the extractor via a pin extending through the pin opening;

the bolt defines a protrusion recess configured to receive the protrusion on the extractor; and during operation, the extractor is configured to translate along the elongated shape of the pin opening so that the front surface of the protrusion engages a distal surface of the protrusion recess.

19. The bolt assembly of claim 18, wherein the bolt assembly is configured for use in a machine gun.

20. A parts kit comprising:

an extractor having an extractor body extending from a proximal end portion to a distal end portion, the distal end portion extending along an extractor central axis and defining an extractor hook configured to engage a firearm cartridge, the extractor body defining a pin opening extending crosswise through the extractor body and having an elongated shape and the extractor body defining a protrusion between the pin opening and the extractor hook, the protrusion extending away from the extractor body, wherein a front surface of the protrusion defines an angle of less than 90° with the extractor central axis;

an extractor spring; and a pin sized and configured to be received through the pin opening of the extractor.

* * * * *